US008336260B1

(12) United States Patent
Mandall

(10) Patent No.: US 8,336,260 B1
(45) Date of Patent: Dec. 25, 2012

(54) HIGH SECURITY BLAST DOOR LOCK AND SEAL

(75) Inventor: Michael C. Mandall, Phoenix, AZ (US)

(73) Assignee: Armorworks Enterprises LLC, Chandler, AZ (US)

( * ) Notice: Subject to any disclaimer, the term of this patent is extended or adjusted under 35 U.S.C. 154(b) by 0 days.

(21) Appl. No.: 13/007,339

(22) Filed: Jan. 14, 2011

(51) Int. Cl.
*E04B 1/346* (2006.01)
*E04B 7/16* (2006.01)

(52) U.S. Cl. ..... 52/64

(58) Field of Classification Search ..... 52/64, 506.01, 52/741.3, 30, 1, 67, 169.1, 169.3, 29, DIG. 12; 49/360, 324, 425, 427
See application file for complete search history.

(56) References Cited

U.S. PATENT DOCUMENTS

| | | | | |
|---|---|---|---|---|
| 2,552,515 | A | 5/1951 | Bremer | |
| 3,714,737 | A * | 2/1973 | Fillion et al. | 49/360 |
| 3,969,563 | A | 7/1976 | Hollis, Sr. | |
| 4,178,859 | A | 12/1979 | Seiz | |
| 4,577,577 | A * | 3/1986 | Eriksson | 114/120 |
| 4,716,683 | A * | 1/1988 | Minter | 49/479.1 |
| 4,720,936 | A * | 1/1988 | Ellingson | 49/480.1 |
| 4,727,789 | A | 3/1988 | Katsanis | |
| 4,935,989 | A * | 6/1990 | Miller | 16/66 |
| 5,060,582 | A | 10/1991 | Salzer | |
| 5,231,935 | A | 8/1993 | Oder | |
| 5,491,992 | A | 2/1996 | Mandall | |
| 5,660,021 | A | 8/1997 | Wolgamot et al. | |
| 5,873,205 | A * | 2/1999 | Hanlon et al. | 52/239 |
| 5,911,763 | A | 6/1999 | Quesada | |
| 5,983,578 | A | 11/1999 | Huttie | |
| 6,209,264 | B1 | 4/2001 | D'Abreu | |
| 6,240,858 | B1 | 6/2001 | Mandall | |
| 6,338,594 | B1 * | 1/2002 | Adler et al. | 405/97 |
| 6,514,011 | B2 * | 2/2003 | Nomura et al. | 405/107 |
| 6,623,210 | B2 * | 9/2003 | Nomura et al. | 405/107 |
| 6,732,479 | B2 * | 5/2004 | Nomura et al. | 52/64 |
| 6,758,504 | B2 | 7/2004 | Mandall | |
| 6,883,440 | B1 | 4/2005 | Correia | |
| 7,000,550 | B1 | 2/2006 | Mandall | |
| 7,114,594 | B2 * | 10/2006 | Rossignol et al. | 187/336 |
| 7,328,934 | B2 * | 2/2008 | Sato | 296/155 |
| 7,341,549 | B2 * | 3/2008 | Jung | 483/59 |

* cited by examiner

*Primary Examiner* — Mark Wendell
*Assistant Examiner* — Keith Minter
(74) *Attorney, Agent, or Firm* — James L. Farmer

(57) ABSTRACT

Methods and apparatus are provided for securely blocking and sealing an access corridor to a secure facility. The exemplary system includes a penetration resistant door disposed in a passage intersecting the access corridor, and dividing it into first and second sides. An actuating mechanism translates the door within the passage between an open position in which the corridor is unblocked, and a closed position in which the corridor is blocked by the door. A locking system is configured to push the door toward one side of the access corridor when the door is in the closed position, compressing a seal disposed between the door and the passage wall, and sealing the first side of the access corridor from the second side.

28 Claims, 12 Drawing Sheets

HIGH SECURITY BLAST DOOR LOCK AND SEAL

TECHNICAL FIELD

The present invention generally relates to doors used in high security facilities, and more particularly relates to a blast door system with a secure arrangement for locking and sealing the door against explosive events and leakage of hazardous materials.

BACKGROUND

Blast resistant doors are typically employed in military and industrial facilities where there exists the potential for an explosion and the release of hazardous or noxious materials, such as for example material storage rooms, laboratories, research facilities, ammunition depots, military facilities, and other high security installations. In such facilities, the doors are generally designed in anticipation of a breaching explosion occurring either within the facility, such as would occur from an accidental explosion of the contents of the facility, or outside the facility, such as from an intentionally directed explosive attack by an intruder or terrorist. Various sealing schemes are incorporated to prevent leakage of dangerous materials and gases from occurring in such events. Typically an overlapping arrangement is used, with the blast door designed to close against the side of the facility (i.e. inside or outside) facing the anticipated explosive event. The pressure pulse from an explosive event thus acts in the direction of closing the door, tending to compress the door against the facility and enhance the sealing effect.

However, in some applications there is a need for a blast door capable of maintaining a seal when exposed to explosions or attacks occurring on either side of the door. For example, certain high security installations employ two blast doors to create a Sally Port intended to contain and seal against explosions occurring either within the facility, or within the Sally Port. Similarly, it may be very advantageous for the doors of an ammunition depot to be capable of withstanding an accidental explosion within the facility, as well as a hostile explosive attack from the outside. In such applications the conventional overlapping door arrangement has unavoidable disadvantages from the standpoint of both security and maintaining integrity of the seal.

From the standpoint of maintaining seal integrity, the door overlap is beneficial in one direction, but generally detrimental in the other direction, providing no inherent resistance against pressure applied to the non-overlapping side of the door. In particular, pressure against the non-overlapping side tends to move the door away from the facility wall rather than toward it, thus weakening or releasing the seal.

From a security standpoint, because the pressure pulse is not being transferred to the facility, the entire load is typically carried by the door latching and bolting mechanisms. The resulting loads can produce excessive shear and tensile stresses in these mechanisms and in the fasteners retaining them to the facility structure. Once weakened, they become more vulnerable to further attacks.

Accordingly, a need exists for a sealable, blast resistant door capable of withstanding an explosive pressure load against either side of the door without degradation of the seal. A further need exists for a blast resistant door with a more robust latching and locking design.

SUMMARY

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment" does not necessarily refer to the same embodiment, although it may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises an apparatus for securing an access corridor to a high security enclosure. The exemplary apparatus comprises a passage intersecting the access corridor, and delineating a secure side of the access corridor on one side of the passage, and a threat side of the access corridor on the other side of the passage. Disposed within the passage is a penetration resistant door oriented with a front surface of the door facing a front wall of the passage and the threat side of the access corridor, and a back side of the door facing a back wall of the passage and the secure side of the access corridor. The apparatus further comprises a system for translating the door within the door passage from an open position in which the access corridor is unblocked, to a closed position in which the door blocks the corridor. The door is dimensionally larger than the access corridor such that in the closed position the perimeter of the door extends into the passage beyond the walls of the corridor. A locking system in the passage outside the corridor is configured to push the door against the front wall of the passage.

In another embodiment, the apparatus further comprises a compressible seal disposed between the door and the front wall of the access corridor.

According to another exemplary embodiment, a method is provided for securing and sealing an access corridor to a high security facility. The method includes the step of providing a passage intersecting the access corridor, delineating a secure side of the access corridor on one side of the passage, and a threat side of the access corridor on the other side of the passage. The method further includes the step of blocking the passage with a penetration resistant door, wherein a front side of the door faces a front wall of the passage and the threat side of the access corridor, and a back side of the door faces a back wall of the passage and the secure side of the access corridor. The method further comprises pushing the door toward the access corridor, and sealing the door with a compressible seal disposed between the perimeter portion of the door and a wall of the passage.

In another embodiment the method may further comprise translating the door from an open position in which the access corridor is unblocked, to a closed position in which the door blocks the access corridor.

Furthermore, other desirable features and characteristics of the present invention will become apparent from the subsequent detailed description and the appended claims, taken in conjunction with the accompanying drawings and the foregoing technical field and background.

BRIEF DESCRIPTION OF THE DRAWINGS

The present invention will hereinafter be described in conjunction with the following drawing figures, wherein like numerals denote like elements, and wherein.

DETAILED DESCRIPTION

The present invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 7:
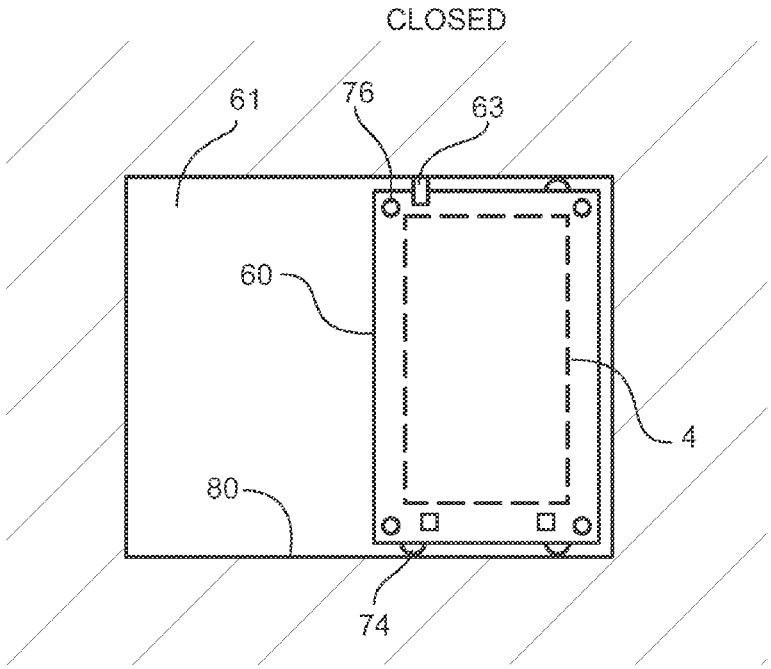
FIG. 7 is a front cross-section view of a secure facility showing a horizontally translating security door in the closed position.
Figure 8:
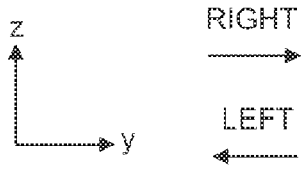
FIG. 8 depicts the horizontally translating security door of FIG. 7 in the open position.
Figure 8:
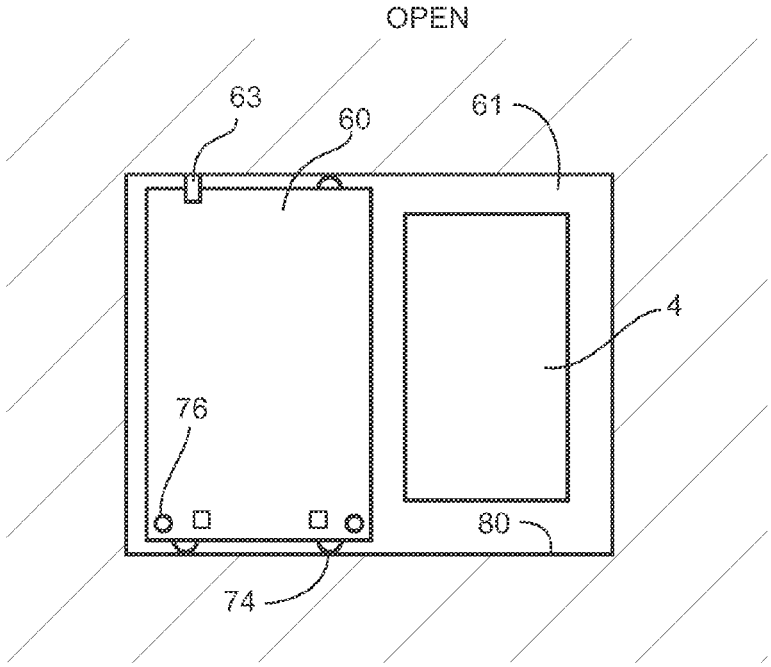
Figure 9:
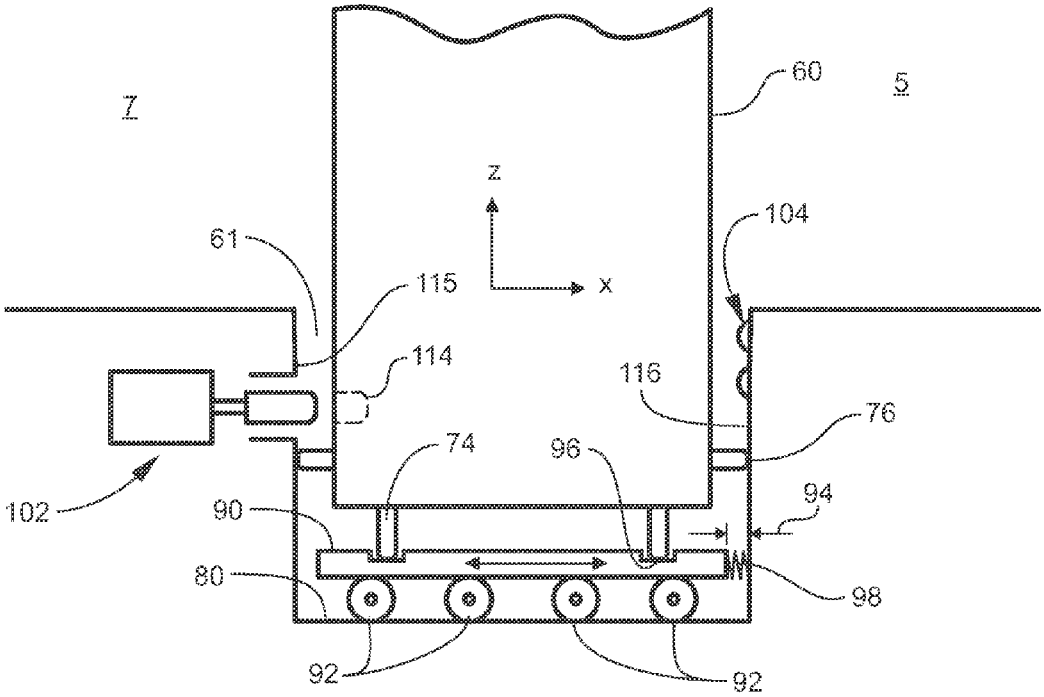
FIG. 9 is a vertical cross section of the bottom portion of the facility and security door of FIG. 7 showing a second roller system.

The present invention comprises generally a translating security door and system for blocking and sealing off an access corridor of a high security facility. Referring now to the drawing figures, a translating door in accordance with the invention may be a door that moves vertically up and down, an example of which is shown in FIGS. 1-6. Alternatively a translating door may comprise a horizontally moving or sliding "pocket" door arrangement, an example of which is illustrated in FIGS. 7-9. In any case, translating door motion refers to motion that is generally along a path that is perpendicular to the direction of an access corridor of the high security facility.

For convenience, certain conventions will be used throughout to reference directions and orientations. With respect to the coordinate directions indicated on the drawings, the plus z direction is "upward"; the minus z direction is "downward"; the plus x direction is "forward"; the minus x direction is "rearward" or "backward"; and the y direction is "lateral" or "sideways". With respect to orientations, the "front" faces forward; the "back" faces rearward; the "right side" faces in the plus y direction; the "left side" faces in the minus y direction; the "top" faces upward; and the "bottom" faces downward.

Vertically Translating Door Embodiment

Figure 1:
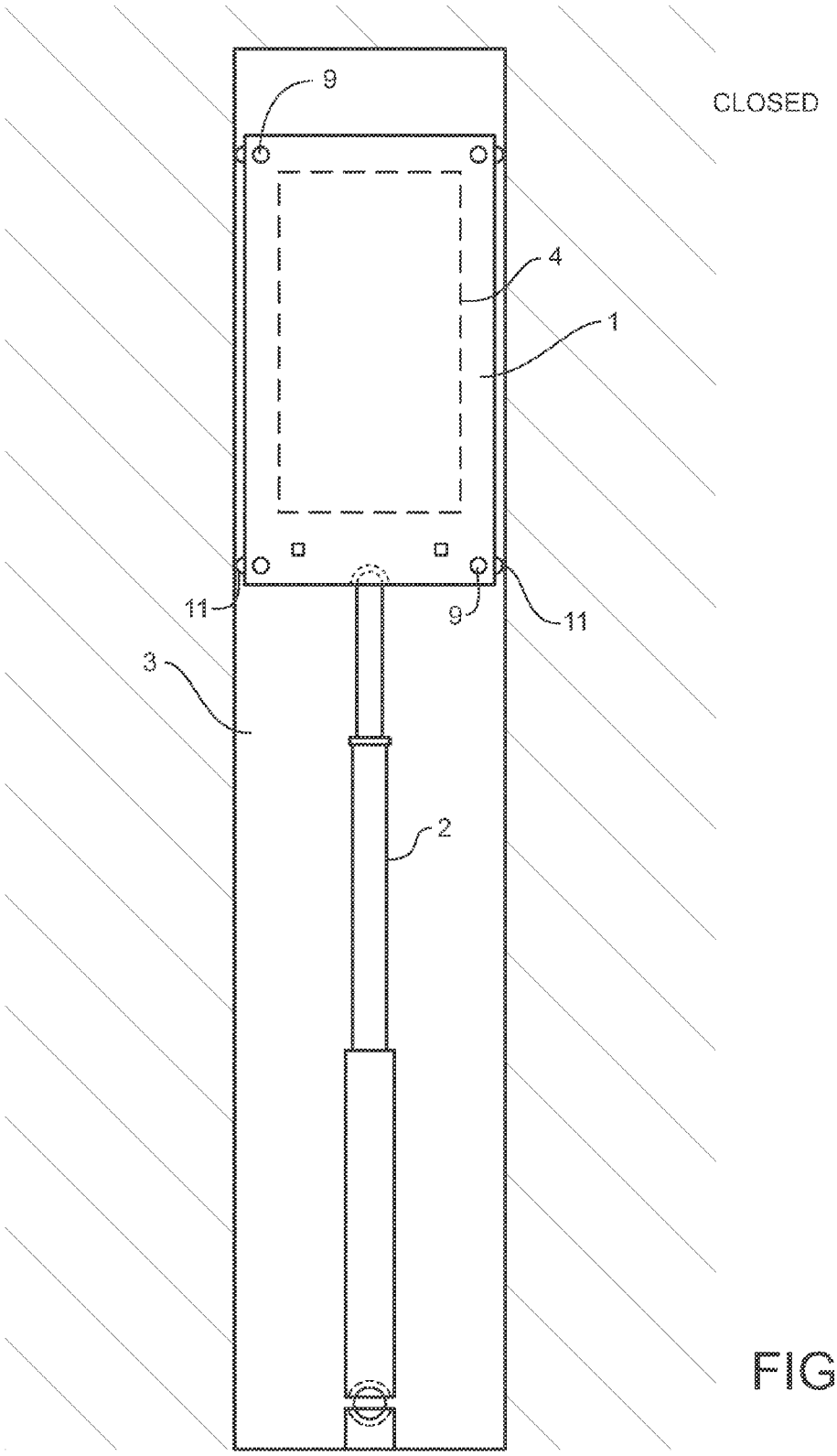
FIG. 1 is a rear elevation of a secure facility showing a vertically translating security door in the raised, closed position.
Figure 2:
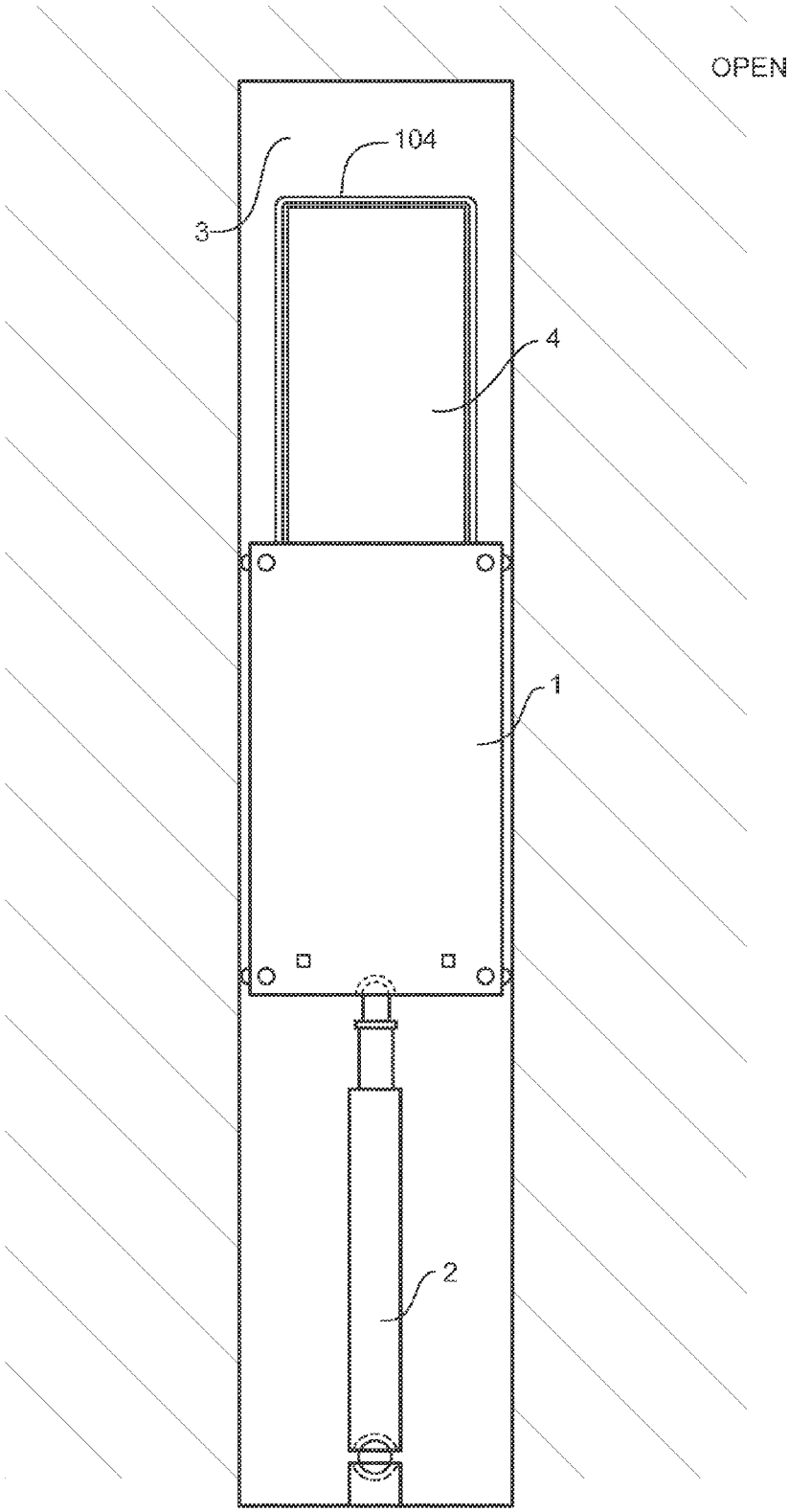
FIG. 2 is another rear elevation of the facility of FIG. 1 showing the security door in the lowered, open position.
Figure 3:
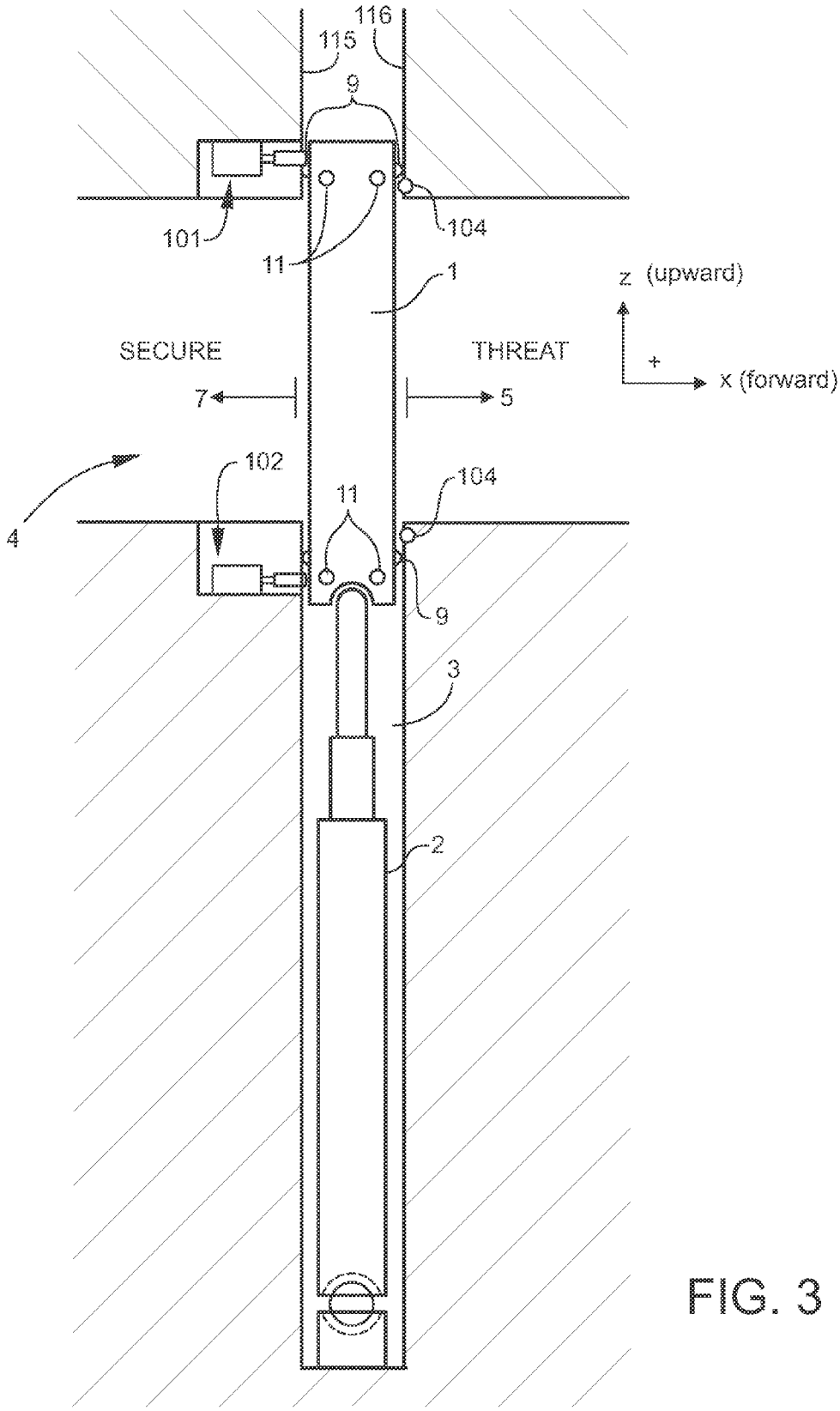
FIG. 3 is a side elevation of the facility of FIG. 1 showing the security door in the raised, closed position.

In one preferred embodiment illustrated in FIGS. 1-3, the security door system comprises a vertically moveable door 1 disposed within a vertical passage 3 and supported atop an extendable cylinder 2. The passage 3 intersects an access corridor 4 to a high security facility, delineating a threat side 5 of corridor 4 on one side, and a secure side 7 on the other side. Passage 3 preferably comprises thick reinforced concrete walls lined with welded armor steel plates. In FIG. 1 the door 1 is depicted in a raised, "closed" position, blocking corridor 4; and in FIG. 2 the door 1 is lowered to an "open" position, unblocking the corridor. The passage 3 is therefore necessarily deep enough to accommodate the entire door beneath the bottom of the corridor 4. In particular, when in the open position the door is preferably located just below corridor 4 such that the top of the door aligns with the floor of corridor 4 and doubles as a floor across the gap of passage 3.

It should be understood that the system of the present invention is not limited to the relative location of the "threat" side of the corridor to the door system as described and depicted in the drawings. Indeed, the door system of the present invention may be suitably and advantageously employed in situations where a toxic or explosive threat is anticipated on either side, or on both sides of the door. Thus the terms "threat" and "secure" are used herein merely for reference purposes, with the intent of simply differentiating between "first" and "second" sides.

Returning to FIGS. 1 through 3, the extendable cylinder 2 is used to raise and lower the door between the open and closed positions. In one embodiment the extendable cylinder is a telescoping hydraulic device, as depicted in the drawing figures, preferably with at least one additional reserve cylinder (not shown) adjacent cylinder 2 to provide redundancy. Alternatively, other well known mechanisms may be employed for vertically moving and positioning the door, such as a screw jack, or a cable and counterweight system of the type used in conventional building elevators.

Door 1 may be a high strength, heavily armored panel designed to resist directed, sophisticated explosive attacks. When in the closed position of FIG. 1, such a door 1 serves to prevent unwanted intrusion into secure regions of the facility accessible through corridor 4. Door 1 is preferably larger than corridor 4, extending substantially above, below, and to either side of the corridor within passage 3. As will become evident from the following description, this overlap of the corridor by door 1 facilitates placement of the door operating and locking mechanisms in secure locations relative to an explosion or would-be attacker.

Door guides 9 and 11 are provided for centering the door within passage 3 and to minimize or eliminate rubbing friction between the door and the walls of the passage. Guides 11 are positioned and configured to guide and center the door laterally, or in the y-direction, while guides 9 center the door front-to-back, or in the x-direction. The door guides may be mounted to the vertical surfaces of the door as shown, or alternatively to the top and bottom of the door. The door guides may comprise bearings, wheels, rollers, or simply blocks of a low friction material such as Teflon®. Preferably the guides have a sufficient degree of compliance, either through the choice of material used or through the mounting configuration, to accommodate dimensional tolerances or misalignment present between the door and passage. Vertical tracks 13 are preferably attached to the armor plating surfaces of passage 3 to provide a hard, smooth, and plumb surface for the door guides. Tracks 13 are preferably made of flat strips of high strength steel. For example in one embodiment tracks 13 are flat strips of 4130 alloy steel, roughly ½ by 4 inches in cross-section.

Figure 4:
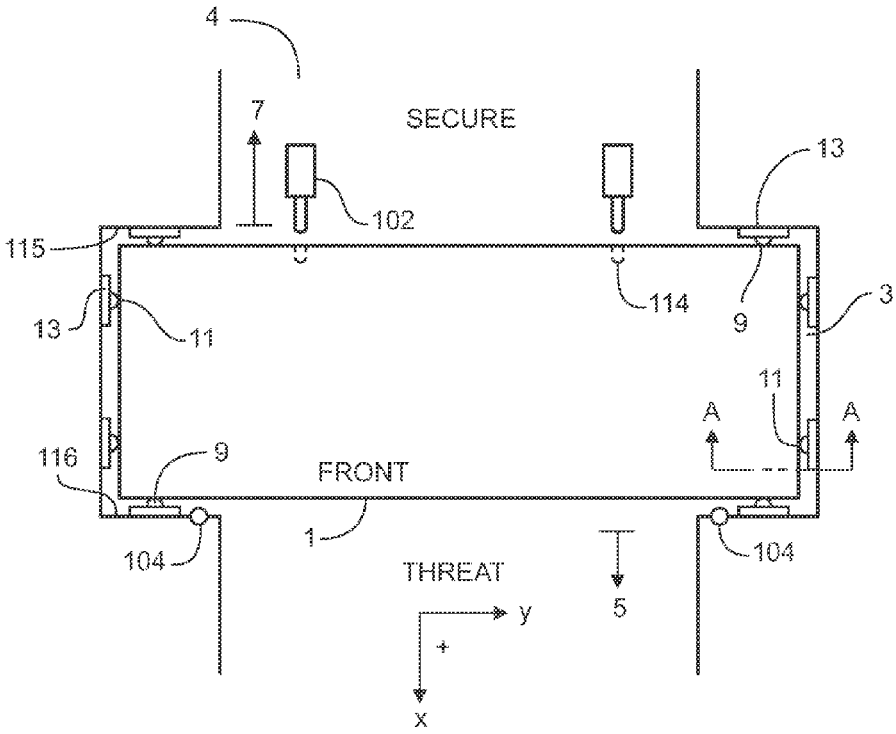
FIG. 4 is a horizontal cross section through the facility and security door of FIG. 1.
Figure 5:
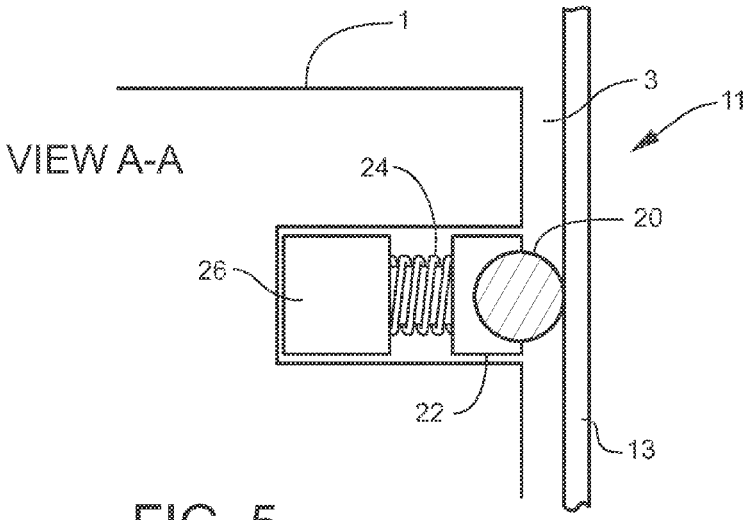
FIG. 5 is a detail cross section view of an exemplary compliant door guide using a spherical roller.

FIGS. 4 and 5 illustrate a door guided by rolling-type front and back door guides 9 and side door guides 11. Referring particularly to FIG. 5, one exemplary door guide comprises a spherical guide roller 20 supported in a hemispherical journal bearing 22. The journal bearing 22 is supported by a mount block 26 and extendable guide rods 27, and biased against the wall of passage 3 by spring 24. The stiffness and length of spring 24 are preferably sufficient to maintain the door in a centered position with respect to passage 3 when the door is being raised or lowered. The spherical rollers 20 are adapted to roll against the passage or pocket wall in any direction, thus facilitating vertical, lateral, or out-of-plane (x-direction) door movement.

Figure 6:
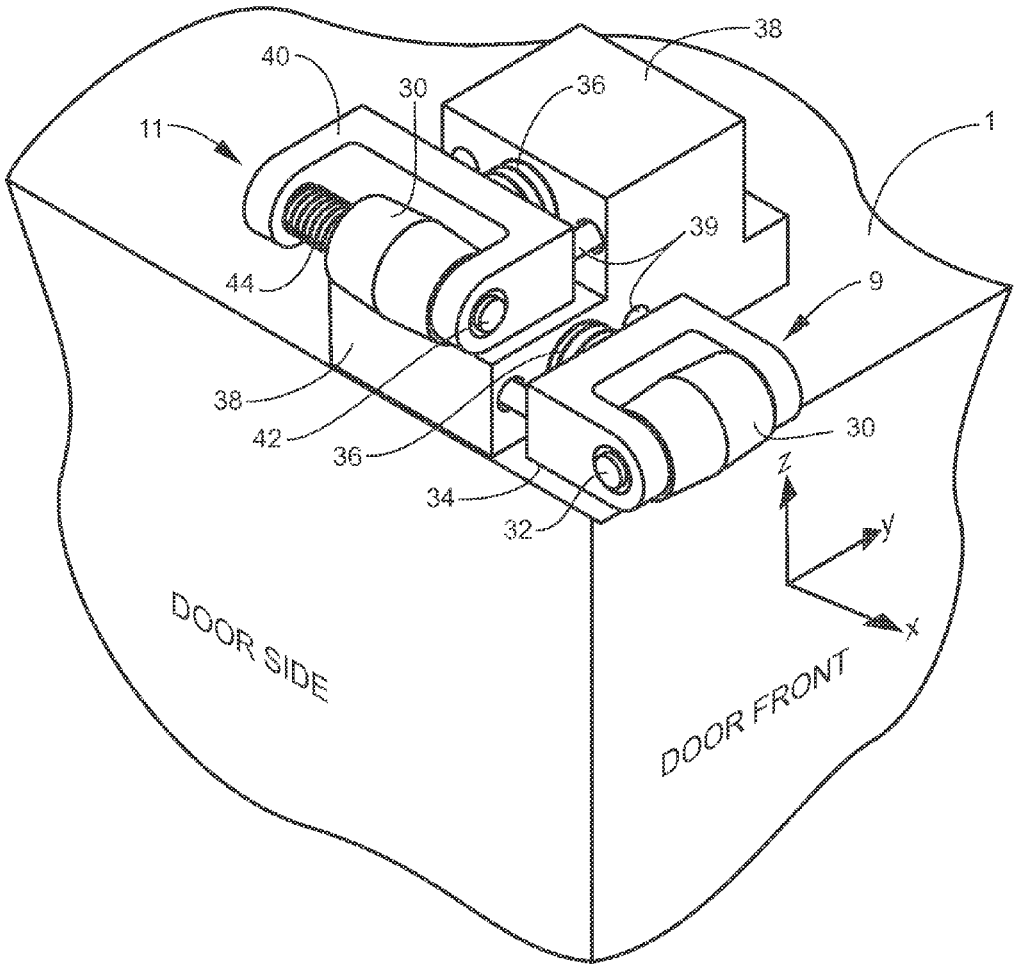
FIG. 6 is a perspective view of another exemplary compliant door guide using cylindrical rollers.

FIG. 6 depicts another embodiment of the door guides comprising rollers mounted to the top and bottom of the door instead of the sides. The door guides of FIG. 6 comprise a generally cylindrical roller 30 mounted for rotation on shafts 32 and 42. Similar to the roller guide of FIG. 5, roller 30 is mounted via mount block 38 and extension rods 39, and biased against the wall of the passage 3 by a compression spring 36. As will be described in more detail below, sealing the door involves moving the door forward toward the threat side 5 of corridor 4 until the door seals against the rearward facing wall 116 of passage 3. The compliance provided by the door guides, in addition to keeping the door centered in the passage 3, enables the door to be intentionally moved off-center if desired by applying enough force to overcome the door guides' spring rate, in this case the stiffness of compression springs 36. In other words, the forward movement of the door associated with a sealing operation is accommodated by compression of the front door guides 9 relative to the door.

It should be noted however that any out of plane (x-direction) movement of the door, as for example in a door sealing operation, would tend to cause the side door guides 11 of the present embodiment to slide instead of roll, creating friction and wear of the rollers 30 and tracks 13. To avoid that, rollers 30 of door guides 11 are supported within a wide bracket 40 on a shaft 42 that is substantially longer than the roller, allowing the bracket and shaft to move forward and backward with the door while the roller 30 remains fixed in place against the wall of the passage. A spring 44 biases the roller 30 forward against the front side of bracket 40 during normal operation, ensuring a wide enough gap between the roller 30 and the other side of bracket 40 to accommodate forward door movement in a door sealing operation. Spring 44 is accordingly selected to be compressible with substantially less force than the friction force required to slide roller 30 on the wall of the passage 3.

In addition, because the door is supported atop the extendable cylinder 2, any forward, backward, or lateral door motion necessarily moves the upper end of cylinder 2 by the same amount. Thus, cylinder 2 is preferably designed in such a way to accommodate the motion of door 1 associated with a door sealing operation for example, without unduly inhibiting the door motion, and without the cylinder itself becoming damaged in the process. In one preferred embodiment, pivoting joints are employed at each end of cylinder 2, allowing the cylinder to freely tilt relative to the door 1 and the passage 3. The pivoting joints may be for example a simple hinge arrangement, providing two degrees of freedom, or more preferably a ball and socket design providing three degrees of freedom.

Pocket Door Configuration

FIGS. 7-9 depict an exemplary pocket door embodiment of the invention in which a door 60 is horizontally moveable inside a horizontal passage, or pocket 61. The door 60 is preferably a heavy, high strength armored panel of the type previously described with reference to door 1. As in the previous embodiment, pocket 61 intersects access corridor 4, delineating the secure side 7 of corridor 4 from the threat side 5. The door 60 is moveable between a closed position shown in FIG. 7, where the door blocks and substantially overlaps corridor 4, and an open position shown in FIG. 8, where the corridor is unblocked. When unblocked, the gap across the bottom of pocket 61 may be covered with a removable or hinged plate (not shown) to act as a temporary bearing floor. The door 60 is preferably moved laterally in the passage 61 using a suitable drive motor 63. The drive motor 63 may be an electric motor, pneumatic actuator, ball screw, or any suitable mechanism capable of moving and accurately positioning door 60 relative to corridor 4. In one preferred embodiment for example, a sprocket attached to the shaft of motor 63 engages a fixed linear gear or chain mounted inside passage 61.

Door 60 is preferably supported vertically in the pocket by a series of support rollers 74 disposed between the bottom of the door and the pocket base 80. The support rollers may be configured for example as wheels or as cylindrical rollers, and are preferably designed to carry the substantial weight of door 60. The door 60 is preferably guided within the pocket by compliant door guides 76 (see FIG. 6) located near the top and bottom of the door. Since pocket door 60 moves laterally, door guides 76 are preferably configured to slide or roll laterally instead of vertically as do guides 9 and 11 on door 1 (see FIG. 4). Otherwise the door guides 76 perform essentially the same function and may be configured in the same manner as the previously described door guides 9. As with door 1, the rollers 74 and door guides 76 are preferably located outside the boundaries of corridor 4, and inaccessible to a potential intruder.

As previously mentioned, a door sealing operation involves moving the door forward until the door physically seals against the rearward facing front wall 116 of the passage 3 or 61. To facilitate that movement in the present embodiment, the pocket door 60 may be supported by a second roller system. Referring to FIG. 9, an exemplary second roller system comprises a floating floor plate 90 supported atop a series of transverse rollers 92 disposed between the floor plate 90 and pocket floor 80. The transverse rollers 92 allow the floating floor plate 90 to freely move forward and backward, while providing a surface on which door 60 can roll laterally between open and closed positions. The floor plate 90 may be provided with one or more springs 98 to ensure that gap 94 along the back edge of plate 90 is large enough for the plate and door to move rearward the desired amount without the plate 90 contacting the pocket wall. Additionally, the drive mechanism associated with drive motor 63 is preferably configured to disengage or move freely with the door so as not to inhibit x-direction door motion. Grooves 96 may be provided in the top of floating plate 90 to positively locate the support rollers 74 and the door 60 relative to the plate 90.

Door Locks

Referring again to FIGS. 3, 4, and 9, a door sealing system comprises a series of upper and lower door locks 101 and 102, and a door seal 104. Door locks 101 and 102 serve generally to push the door forward against the door seal 104, thereby preventing leakage of dangerous materials or gases from one side of the door to the other; and to prevent any movement of the door once in the sealed position. In one embodiment a series of lower door locks 102 are provided in the back wall 115 of passage 3 beneath the floor of corridor 7 facing a lower portion of the back of door 1. Similarly, a series of upper door locks 101 are provided in the back wall 115 of passage 3 above the ceiling of corridor 7, facing an upper portion of the back of door 1. Each door lock comprises generally an actuated bolt, and a mechanism for bracing the bolt in an extended, locked position.

Figure 10:
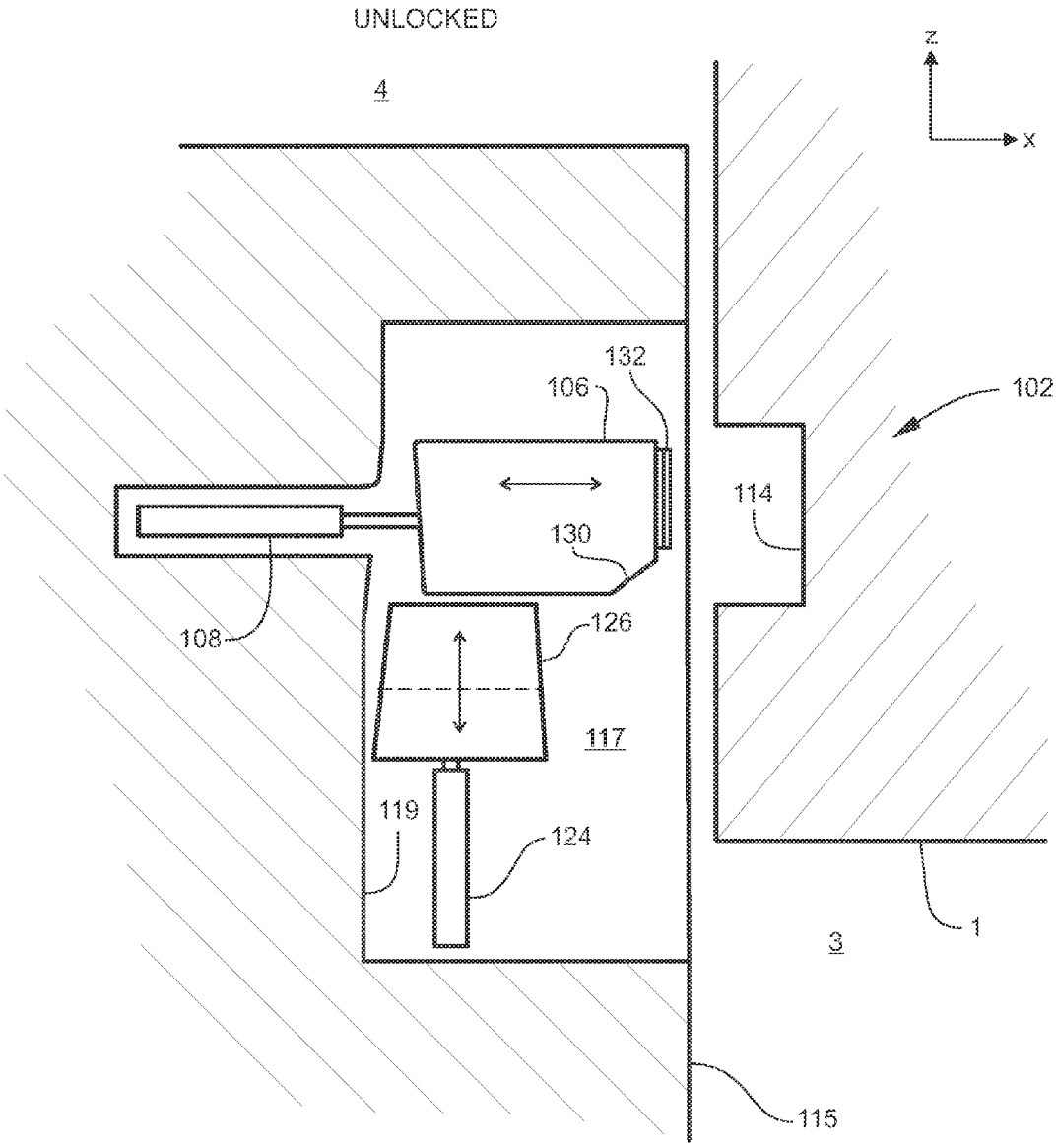
FIG. 10 is a side view of an exemplary door lock mechanism shown in the retracted and unlocked position.
Figure 11:
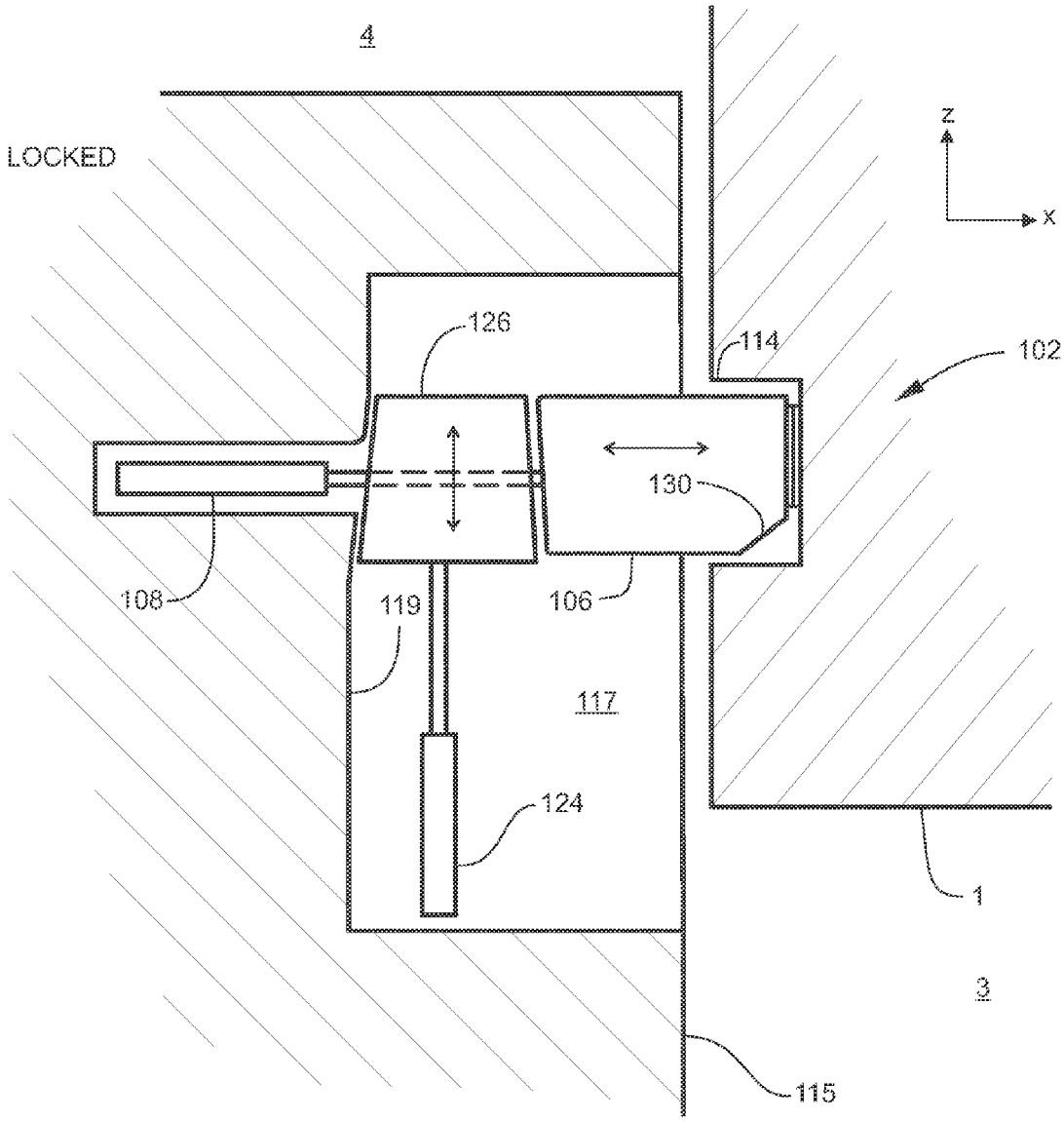
FIG. 11 is a side view of the door lock mechanism of FIG. 10 shown in the extended and locked position.
Figure 12:
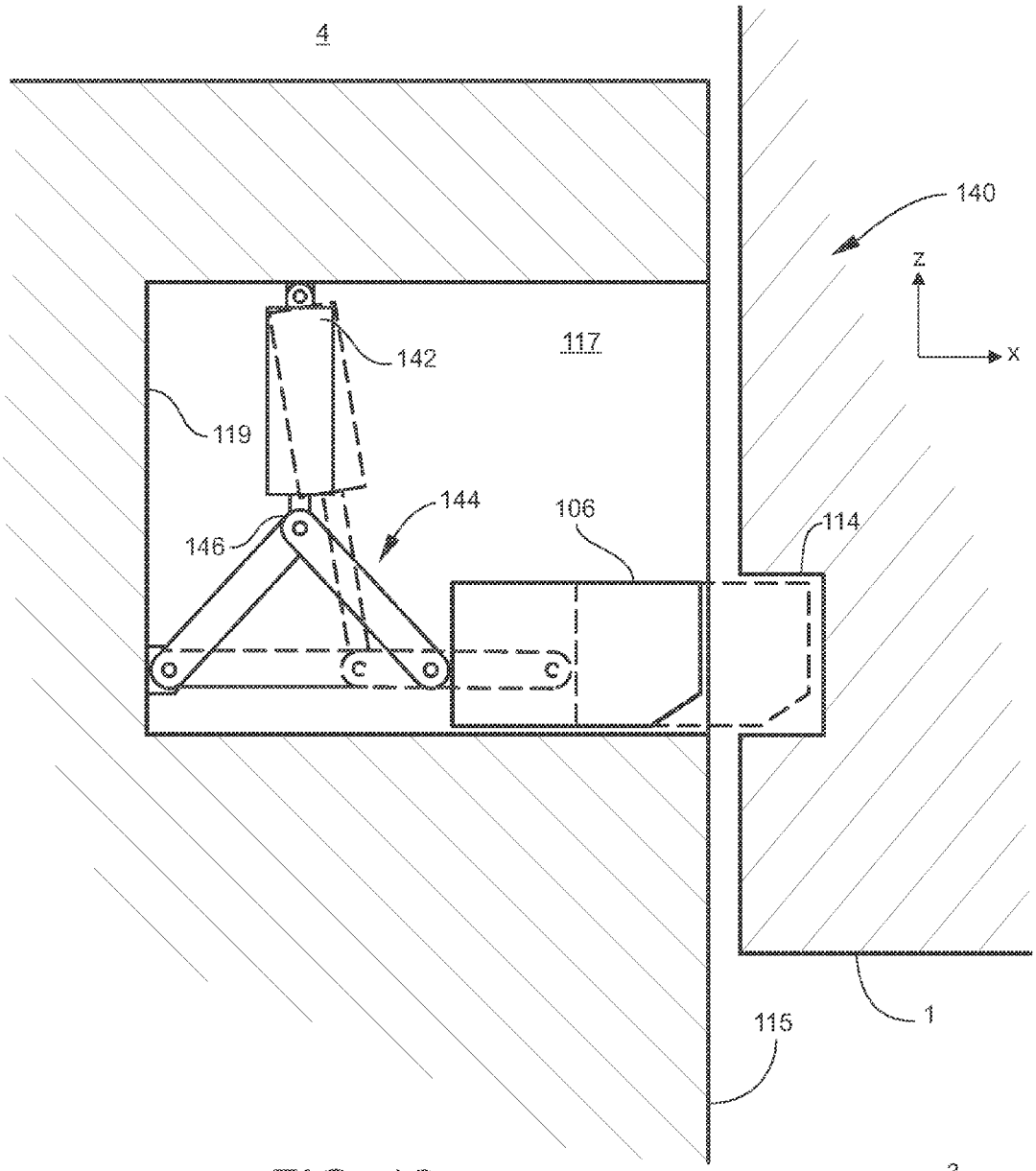
FIG. 12 is a side view of another exemplary door lock mechanism based on a four bar linkage concept.

FIGS. 10 through 12 depict two exemplary door lock mechanisms in accordance with the present invention. Referring first to FIG. 10, an exemplary lower door lock mechanism 102 comprises a bolt 106, bolt actuator 108, locking block 126, and locking block actuator 124. The lower door lock mechanism is preferably located in a cavity 117 formed in the back wall 115 of passage 3 beneath the threat side 7 of corridor 4. In FIG. 10 door lock 102 is shown in an unlocked condition, with bolt 106 fully retracted by actuator 108 such that the end of bolt 106 facing the door is preferably flush or slightly recessed from surface 115 of passage 3, and well away from door 1. FIG. 11 shows the same lock mechanism 102 in a locked condition, with the bolt 106 driven forward against the back of door 1. In the locked condition, locking actuator 124 is extended in a direction perpendicular to the path of bolt 106, placing the locking block 126 between bolt 106 and the back wall 119 of cavity 117. Block 126 may include a slot (not shown) that aligns with the extended rod of bolt actuator 108 allowing block 126 to slide past the rod as shown. Thus bolt 106 and locking block 126 create a solid load path between the door and the back wall of cavity 117 through which a pressure pulse applied against the front of door 1 can be directly reacted into the facility structure. In this way the door lock mechanism serves to maintain seal integrity by preventing rearward deflection of the door when the mechanism is locked.

Going from the locked condition of FIG. 11 to the unlocked condition of FIG. 10 comprises first retracting the locking actuator 124 to withdraw the locking block 126 from behind bolt 106. The bolt actuator 108 may then be retracted to move the bolt 106 to the unlocked position of FIG. 10. A slight taper in the surfaces of locking block 126 that abut wall 119, and/or block 126 may be incorporated as shown to facilitate retraction of the block 126 after a locking operation.

The door locks of the present invention may in addition act to prevent in-plane (y-z) door motion when locked. A series of sockets 114 are defined in the back surface of door for receiving the lock bolts. Should there be a failure of the system that positions the door vertically or laterally within the passage, such as a loss of pressure in cylinder 2, the engagement of the lock bolts 106 in sockets 114 acts to secure the door and prevent in-plane movement or slipping. A taper 130 may be provided on at least one edge of bolt 106 where it engages socket 114. The taper 130 helps to ensure adequate alignment between bolts 106 and sockets 114, and prevent bolt 106 from binding or becoming lodged in socket 114. A shim stack 132 affixed to the end of bolt 106 as shown, or alternatively inside socket 114, may be incorporated to adjust the position of the door, and the compression of seal 104.

Although FIGS. 10 and 11 refer to a lower door lock 102, it should be appreciated that the same type of mechanism is also suitable for upper door locks 101, and moreover for door locks located anywhere on the back wall 115 of passage 3 opposite a perimeter portion of door 1. It should be further appreciated that not all of the door lock mechanisms are necessarily configured to engage a socket 114 in door 1. For example, in one particularly preferred embodiment, the bolts of lower door locks 102 engage sockets 114 in door 1, and the bolts of upper door locks 101 directly abut the back surface of door 1.

FIG. 12 depicts another embodiment of a door lock mechanism, based on a four bar linkage concept, suitable for upper and lower door locks 101 and 102 of FIG. 3. Door lock mechanism 140 comprises a bolt 106, a linkage assembly 144 connected to bolt 106, and an actuator 142 connected to a hinge (or knuckle) 146 of linkage assembly 144. Like the door lock of FIGS. 10, 11, the mechanism 140 of FIG. 12 is also preferably located in a cavity 117 in the back wall 115 of passage 3 facing door 1.

Solid lines in FIG. 12 depict mechanism 140 in a retracted, unlocked position, while dashed lines are used to show the mechanism in the extended, locked position. In the unlocked position, actuator 142 is retracted, and linkage assembly 144 is folded about hinge 146 with bolt 106 recessed behind wall 115, away from the door. Going from an unlocked position to a locked position is obtained by extending actuator 142, thereby straightening and lengthening linkage 144, and moving bolt 106 forward against door 1. In the locked position, bolt 106 and linkage 144 provide a solid load path through which a pressure pulse applied against the front of door 1 can be directly reacted against the back wall 119 of cavity 117 and into the facility structure. Accordingly the door lock mechanism 140 serves to maintain seal integrity by preventing rearward deflection of the door when the mechanism is locked. Bolt 106 may be moved back to an unlocked position by retracting actuator 142, thereby shortening linkage 144 and moving bolt 106 away from the door. Door lock mechanism 140 may also be configured to engage sockets 114 in door 1 to lock the door against vertical or lateral movement.

Door Seal

As mentioned above, the door is closed and sealed by forcing the door forward against door seal 104 in the front wall 116 of passage 3 or pocket 61. The door seal 104 is mounted in, or on the front wall around the opening to the threat side 5 of corridor 4, and may comprise any suitable flexible material such as metal strips, foam, o-rings, and the like. In one preferred embodiment depicted in FIGS. 13 and 14, the door seal 104 comprises two o-rings 200 spaced apart from one another and partially embedded in front wall 116. The o-rings 200 may be solid, or more preferably the hollow tube construction depicted.

Figure 13:
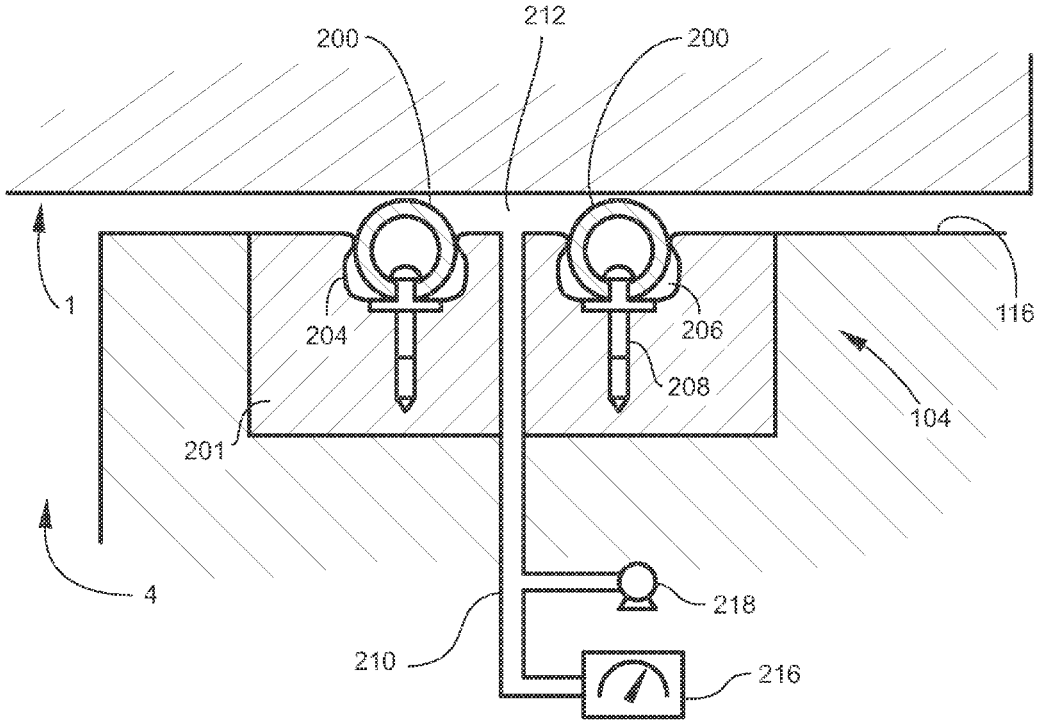
FIG. 13 is a cross section of a portion of a security door system of the present invention containing a double o-ring seal assembly.
Figure 14:
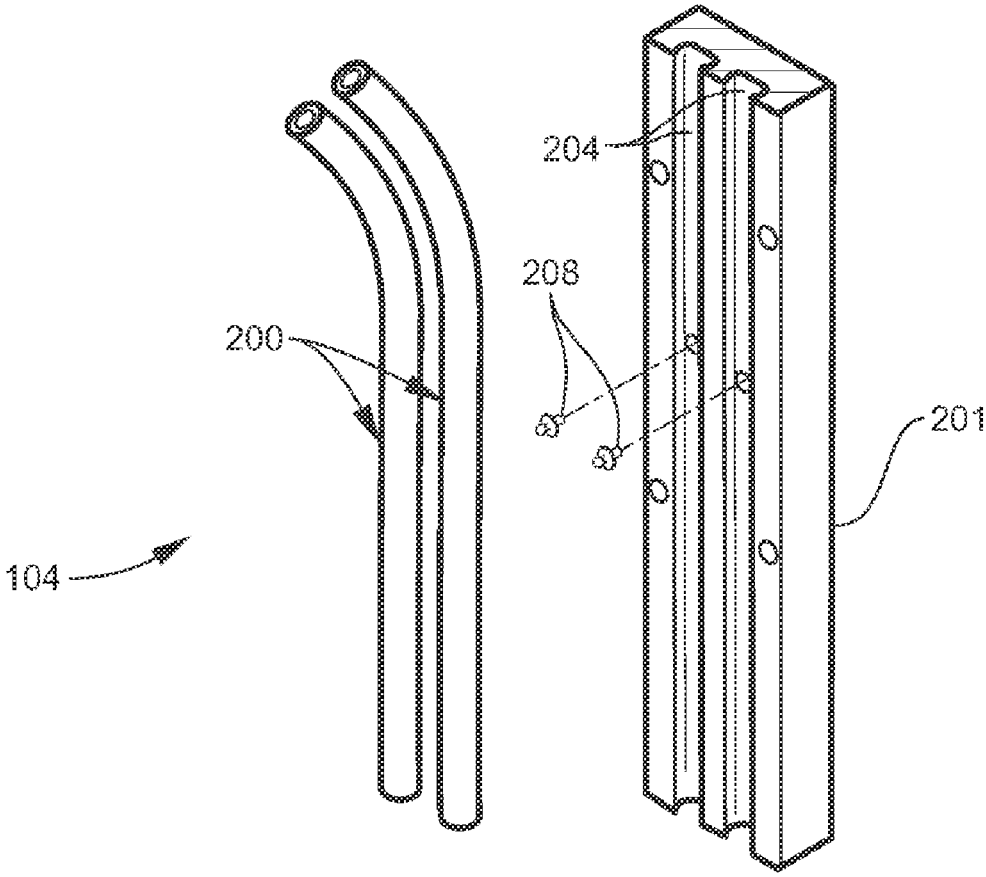
FIG. 14 is an exploded perspective view of the o-ring and seal carrier elements of seal assembly in FIG. 13.

In one particularly preferred embodiment shown in FIGS. 13 and 14, the seal 104 is an assembly comprising double hollow o-rings 200 and a rigid seal carrier 201. The seal carrier 201 fits flush within a recess in front wall 116, and incorporates o-ring grooves 204 for receiving o-rings 200. The grooves 204 are preferably deep enough such that less than half the o-ring protrudes beyond the surface of carrier 201. The grooves 204 may further include an undercut 206 defining a pocket that is wider than the o-rings to allow room for the o-rings to expand when compressed by the door.

The o-rings may be secured into grooves 204 using barbed studs 208 mounted in the bottom of the grooves. The barbed studs allow for a blind installation whereby aligned holes in the back of the o-rings (not shown) are snapped over the barbed end of the studs by simply pushing the o-rings into the grooves. A worn o-ring may be conveniently replaced by pulling out the old o-ring and installing a new one without necessarily replacing the barbed studs 208 or carrier 201. Alternatively, the carrier and o-ring assembly may be replaced as a unit.

The door seal 104 may further include at least one conduit 210 with a first end in fluid communication with a sealed space 212 formed between o-ring seals 200. A second end of conduit 210 is preferably adapted for connection to external devices, such as a pump 218 and a pressure gauge 216. With the door closed, the quality of the seal can thus be inspected by pumping air into sealed space 212 with pump 218, and monitoring the bleed down rate using pressure gauge 216. Conduit 210 may additionally be utilized as a vent to prevent a vacuum condition in space 212 from trapping the door against the seal when the locks are disengaged. Alternatively if venting alone is insufficient, air may be pumped through conduit 210 into space 212 to positively break a vacuum condition.

Operation

The process of closing, latching, and sealing the high security door according to the present invention involves first translating the door within a passage or pocket from an open position in which corridor 4 is unblocked, to a closed position in which corridor 4 is blocked. For example the translating step may comprise moving the door vertically from an open position shown in FIG. 2 to a closed position shown in FIG. 1, or horizontally from an open position shown in FIG. 8 to a closed position shown in FIG. 7. A positioning device such as cylinder 2 or drive motor 63 is used to accurately move and locate the door in the closed and open positions. Compliant door guides 9, 11, 76 facilitate the door translation by helping to keep the door centered in the passage, and reducing friction with the walls.

With the door translated into the closed position, but still centered in the passage, the bolts 106 of the upper and lower door locks 101 and 102 are driven forward against the back of door. The door locks may be configured such that the lower door bolts are driven into sockets 114, preventing further translational door movement, and supporting the door if necessary. Force applied to the door by the bolts pushes the door forward against the door seal 104, compressing the seal, and compressing door guides 9 or 76 on the front of the door against the front wall 116 of passage 3. The o-rings 200 expand in grooves 204 as the seal 104 compresses, allowing the door to continue moving forward until it abuts the back wall 116 if desired, sealing off corridor 4. A locking feature of the door locks braces the bolts against the back wall of the passage 3 to prevent any subsequent rearward motion of the door. The small forward and backward door movements associated with sealing and unsealing are accommodated by pivoting ends on cylinder 2 in a vertically moving door embodiment, or by a secondary roller system associated with the laterally moving pocket door embodiment.

Unlocking and opening the door involves first disengaging the locking feature and retracting the upper and lower door locks 101 and 102. The previously compressed door guides 9 on the front of the door extend under spring bias, forcing the door away from front wall 116 to a centered position in passage 3 or pocket 61. Any resistance due to a vacuum condition between o-ring seals 200 may be alleviated by venting or applying positive pressure to space 212 via conduits 210. Once the door is properly centered, and clear of seal 104, cylinder 2 or drive motor 63 may be operated to translate the door to an open position. In the case of a vertically moving door, the top of the door preferably doubles as a floor across the gap of passage 3 or pocket 61 with the door in the open position.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

What is claimed is:

1. An apparatus for securing an access corridor to a high security facility, comprising:

a door passage intersecting the access corridor, and delineating a secure side of the access corridor on one side of the door passage, and a threat side of the access corridor on the other side of the door passage;

a penetration resistant door disposed within the passage, and oriented with a front surface of the door facing a front wall of the passage and the threat side of the access corridor, and a back side of the door facing a back wall of the passage and the secure side of the access corridor;

a system for translating the door within the door passage between an open position in which the access corridor is unblocked, and a closed position in which the door blocks the access corridor, the perimeter of the door extending into the passage beyond the walls of the corridor in the closed position; and a locking system in the passage configured to push the door toward the front wall of the passage, the locking system comprising at least two actuated bolts, sockets in the door configured to receive an end of the bolts, and a shim stack between the ends of the bolts and the door.

2. The apparatus of claim 1, wherein the door translates vertically within the passage.

3. The apparatus of claim 2, wherein the door is positioned beneath the access corridor in the open position such that the top of the door is generally flush with the floor of the corridor.

4. The apparatus of claim 3, wherein the system for translating the door within the door passage comprises an extendable cylinder mounted in the passage beneath the door.

5. The apparatus of claim 4, further comprising a pivot at each end of the cylinder.

6. The apparatus of claim 1, further comprising a compressible seal disposed on the front wall of the passage around the corridor opening.

7. The apparatus of claim 6, wherein the compressible seal comprises at least one o-ring seated in a groove.

8. The apparatus of claim 7, wherein the compressible seal comprises two o-rings seated in grooves in the face of a seal carrier frame mounted in the wall of the passage.

9. The apparatus of claim 8, wherein the grooves are undercut to define a gap into which the seal can expand when compressed by the door.

10. The apparatus of claim 9, further comprising barbed studs in the bottom of the grooves for blind attachment of the o-rings to the seal carrier frame.

11. The apparatus of claim 8, further comprising a conduit in fluid communication with a sealed space formed between the o-ring seals.

12. The apparatus of claim 11, further comprising a pressure sensor and a pump connected to the conduit.

13. The apparatus of claim 1, wherein the locking system comprises a series of lower door locks located beneath the corridor, and a series of upper door locks located above the corridor.

14. The apparatus of claim 13, wherein the door locks comprise a bolt, a bolt actuator configured to drive the bolt against the door, a locking block, and a locking actuator configured to move the locking block behind the bolt and brace the bolt in an extended position.

15. The apparatus of claim 14, wherein the direction of movement of the locking actuator is normal to the direction of movement of the bolt actuator.

16. The apparatus of claim 14, wherein the bolt comprises a straight portion and a tapered end portion.

17. The apparatus of claim 2, further comprising compliant door guides extending from the door and configured to contact the walls of the passage.

18. The apparatus of claim 17, wherein the compliant door guides each comprise a rolling element biased against the wall of the passage.

19. The apparatus of claim 18, wherein the rolling element comprises a cylindrical roller supported on a shaft held in a bracket, and oriented to roll in a vertical direction along the walls of the passage.

20. An apparatus for securing an access corridor to a high security facility, comprising:

a door passage intersecting the access corridor, and delineating a secure side of the access corridor on one side of the door passage, and a threat side of the access corridor on the other side of the door passage;

a penetration resistant door disposed within the passage, and oriented with a front surface of the door facing a front wall of the passage and the threat side of the access corridor, and a back side of the door facing a back wall of the passage and the secure side of the access corridor;

a system for translating the door within the door passage between an open position in which the access corridor is unblocked, and a closed position in which the door blocks the access corridor, wherein the door translates vertically within the passage, and the perimeter of the door extends into the passage beyond the walls of the corridor in the closed position;

a locking system in the passage configured to push the door toward the front wall of the passage;

compliant door guides extending from the door and configured to contact the walls of the passage, the compliant door guides each comprising a rolling element biased against the wall of the passage, wherein the rolling element comprises a cylindrical roller supported on a shaft held in a bracket oriented to roll in a vertical direction along the walls of the passage; and wherein the door guides in contact with the side walls of the passage comprise a bracket substantially wider than the cylindrical roller, and a spring disposed about the shaft between the roller and one side of the bracket biasing the roller to the other side of the bracket.

21. The apparatus of claim 20, wherein the spring biases the roller toward the front side of the door against a front side of the bracket.

22. The apparatus of claim 21, wherein a gap between the roller and a back side of the bracket is sufficient to accommodate door movement when the locking system pushes the door toward the front wall of the passage.

23. A method for securing and sealing an access corridor to a high security facility, comprising the steps of:

providing a passage that intersects the access corridor, delineating a first side of the access corridor on one side of the passage, and a second side of the access corridor on the other side of the passage;

blocking the passage with a penetration resistant door, wherein a front surface of the door faces a front wall of the passage and the first side of the access corridor, and a back side of the door faces a back wall of the passage and the second side of the access corridor;

pushing the door toward the front wall of the access corridor using a locking system that drives a bolt against the perimeter portion of the door, the bolt engaging a socket in the door;

bracing the bolt against the back wall of the passage; and sealing the access corridor with a compressible seal disposed between the door and the front wall of the passage.

24. The method of claim 23, wherein blocking the passage with a penetration resistant door comprises translating the door from an open position in which the access corridor is unblocked, to a closed position in which the door blocks the access corridor.

25. The method of claim 24, wherein translating the door comprises moving the door in a vertical direction.

26. The method of claim 24, wherein translating the door comprises operating a pressure cylinder mounted in the passage beneath the door.

27. The method of claim 24, wherein the top of the door aligns with a floor of the access corridor when the door is in the open position.

28. The method of claim 23, wherein the compressible seal comprises an o-ring seal partially embedded in the front wall of the passage.

* * * * *